United States Patent [19]

Murphy et al.

[11] Patent Number: 4,723,108

[45] Date of Patent: Feb. 2, 1988

[54] REFERENCE CIRCUIT

[75] Inventors: Colin N. Murphy, San Mateo; Robert G. Pugh, Menlo Park, both of Calif.

[73] Assignee: Cypress Semiconductor Corporation, San Jose, Calif.

[21] Appl. No.: 886,835

[22] Filed: Jul. 16, 1986

[51] Int. Cl.[4] ..... G05F 3/26

[52] U.S. Cl. ..... 323/315; 307/304

[58] Field of Search ..... 323/312, 313, 314, 315, 323/316; 307/296 R, 297, 304, 310, 491

[56] References Cited

U.S. PATENT DOCUMENTS

| | | | |
|---|---|---|---|
| 4,158,804 | 6/1979 | Butler et al. | 307/304 X |
| 4,327,321 | 4/1982 | Suzuki et al. | 323/315 |
| 4,342,926 | 8/1982 | Whatley | 307/304 X |
| 4,477,737 | 10/1984 | Ulmer et al. | 323/316 X |

*Primary Examiner*—Patrick R. Salce
*Assistant Examiner*—Kristine Peckman
*Attorney, Agent, or Firm*—Blakely, Sokoloff, Taylor & Zafman

[57] ABSTRACT

A reference circuit for compensating for the natural response of MOS circuits to changes in temperature and manufacturing variances. The reference circuit comprises a voltage reference circuit that generates a stable current over variations of temperature and includes a current mirror circuit coupled to a first MOS transistor which is biased so that its change in threshold voltage due to temperature variations is compensated by its change in transconductance due to temperature variations, which voltage reference circuit produces a stable current through a second MOS transistor, which stable current is applied to a voltage generator circuit which modulates the gate bias voltage of a third MOS transistor such that the gate to source bias of the third MOS transistor is varied to compensate for variations in temperature.

8 Claims, 5 Drawing Figures

REFERENCE CIRCUIT

BACKGROUND OF THE INVENTION

The invention relates to the field of integrated circuits and, in particular, to reference circuits for integrated circuits.

The invention allows the circuit designer to compensate for variations in the behavior of circuits due to the effect of temperature variations and variations in the electrical properties in integrated circuit components caused by manufacturing tolerances (e.g. the difficulty in manufacturing several transistors with precisely the same channel length). MOS integrated circuits, in general, show large variations in speed of operation due to the fact that the transconductance of an MOS transistor is proportional to its channel length. This dimension is made as small as possible to maximize the speed of operation and to maximize the number of transistors which may be included on a semiconductor substrate. Significant variations in the channel length and the speed of operation are the consequence of a desire to make the channel as short as possible. Other manufacturing tolerances also speed or slow the operation of circuits, usually to a lesser degree than the channel length.

Temperature variations cause large variations in the speed of MOS circuit operation because it affects the transconductance of MOS transistors. Typically, transconductance of MOS transistors is inversely proportional to temperature, such that an increase in temperature will result in a decrease in transconductance. The effect of these variations, including the variations in temperature and manufacturing tolerances, can be minimized by the use of the invention in conjunction with other circuit elements that are normally used in the construction of functional circuits. The invention permits the circuit operation to be stabilized, without significant change in the circuit implementation.

The present invention allows the fabrication of MOS integrated circuits which have a smaller variation in their speed of operation, over temperature and manufacturing process variation than previous methods.

II. SUMMARY OF INVENTION

The invention consists of a reference circuit, usually implemented in MOS circuitry, that acts to compensate for the natural response of MOS circuits to changes in temperature and variations in the components of which the circuit is constructed. The invention accomplishes its results by altering the gate bias voltage of a transistor so that a voltage is modulated (up or down) when transistor mobility (e.g., transconductance) is altered by the effect of temperature. For example, when transistor mobility is reduced under conditions of higher temperature, the gate bias voltage is increased to such a degree that the transconductance of the transistor is actually increased to reverse the effect of temperature on other transistors. The invention includes two reference circuits blocks, the first (a voltage reference circuit) biasing the second (a voltage generator circuit controlling gate bias voltage). Often, there are additional transistors inserted in the circuit, which transistors are being modulated by the two reference circuits. Various uses of the invention are described below, including uses in buffers and clocked circuits.

III. DESCRIPTION OF DRAWINGS

IV. DETAILED DESCRIPTION OF THE INVENTION

The invention includes two reference circuit blocks. The first reference circuit block, a voltage reference circuit, biases the second reference circuit block which is a voltage generator circuit controlling the gate bias voltage of a transistor. That gate bias voltage is modulated to compensate for the natural response of MOS circuits to variations in temperature.

In the following description numerous specific details, such as schematic diagrams, voltages, etc. are set forth to provide a thorough understanding of the invention. However, it will be obvious to one skilled in the art that the invention may be practiced without the use of these specific details. In other instances, well-known circuits are shown in block diagram form in order not to obscure the present invention in unnecessary detail.

Figure 1:
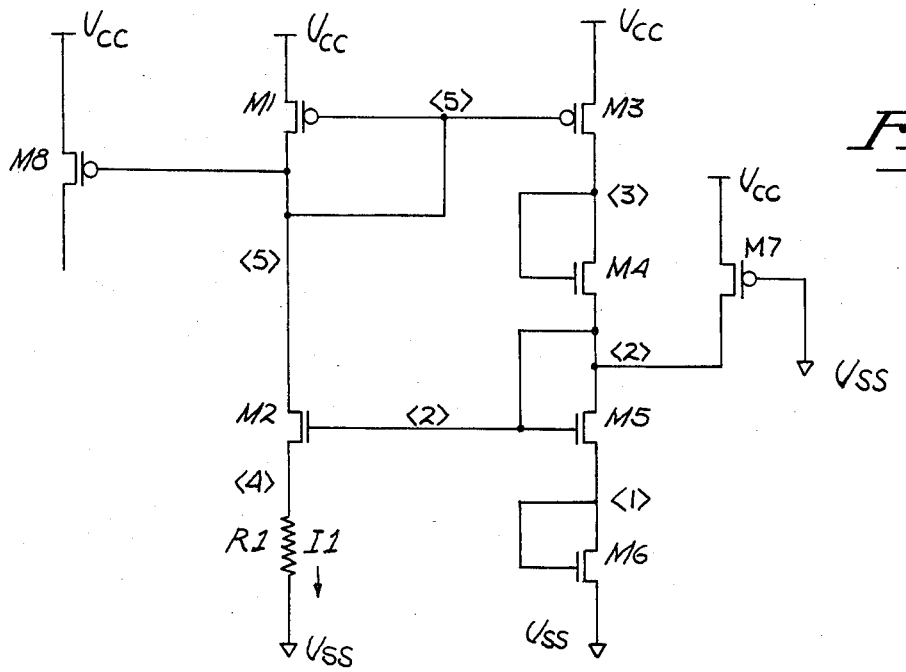
FIG. 1 shows a schematic drawing of an embodiment of a voltage reference circuit.

In the accompanying figures, n-channel ("NMOS") transistors are illustrated as shown by transistor M-6 of FIG. 1. The p-channel transistors are illustrated as shown by transistor M-8 of FIG. 1. Thus, transistors M-2, M-4, M-5 and M-6 of FIG. 1 are n-channel transistors. All the transistors in the embodiment shown herein are enhancement-mode devices. In the normal use of the invention, a power supply voltage is provided at the $V_{cc}$ connection shown in the Figures. Typically, $V_{cc}$ is maintained at +5 volts. Also, in the normal use of the invention, the $V_{ss}$ connection shown in the Figures is maintained at ground. Of course, other voltages may be utilized by those skilled in the art for $V_{cc}$ and $V_{ss}$.

Referring now to FIG. 1, which shows the first circuit block, the reference voltage appears at node 5 which is coupled to transistor M-8 of FIG. 1. The transistor M-1 and M-3 of FIG. 1 form a current mirror. This first circuit block, shown in FIG. 1, is a voltage reference that generates a current through transistor M-8 of FIG. 1, which is stable over voltage and temperature variations. The voltage at node 1 of FIG. 1 is set by the mobility and threshold voltage ("Vth") of M-6 of FIG. 1, which parameters vary with temperature, and the physical dimensions of M-6, such as its gate width "W" and gate length "L", and the gate capacitance Cox. The voltage at node 4 of FIG. 1 is approximately equal to the voltage at node 1 of FIG. 1 because M-5 of FIG. 1 mirrors its gate voltage to the gate of M-2 of FIG. 1. The current I-1 through M-1 and M-2 of FIG. 1 is set by the voltage at node 4 ("V(4)") and the resistance R-1; that is, I-1 is equal to V(4) divided by R-1. This current I-1 is in turn mirrored back to M-6 of FIG. 1 by the current mirror from M-1 to M-3. It is noted that the gate to source voltage ("VGS") for M-1 of FIG. 1 is equal to that of M-3 of FIG. 1. The reference voltage at node 5 of FIG. 1 tends to cause a stable current through M-8 of FIG. 1 because it is set by M-6 of FIG.

1, an n-channel transistor which is biased so that its change in threshold voltage due to temperature variations compensates for its change in mobility due to temperature variations. The resistor R-1, through the current mirror, feeds back to M-6 of FIG. 1 the current that is stabilized by modulating the voltage at node 4 of FIG. 1. Thus, as temperature increases during the operation of the circuit, the decreasing threshold voltage of M-6 of FIG. 1 will be approximately matched by the decreasing mobility (and transconductance) of the transistor M-6.

For the proper operation of the circuit shown in FIG. 1, M-1 and M-3 of FIG. 1 should be maintained in saturation. Similarly, M-2 and M-5 of FIG. 1 should also be in saturation. M-1 and M-3 of FIG. 1 should be fabricated so that they have substantially the same physical parameters including physical dimensions (e.g., gate width, gate length, depth of the source and drain, etc.). Similarly, M-2 and M-5 of FIG. 1 should also be fabricated such that they have substantially the same physical parameters, including physical dimensions. Thus, M-1 of FIG. 1 is matched to M-3 of FIG. 1. Similarly, M-2 of FIG. 1 is matched to M-5 of FIG. 1. The gate of M-5 should be coupled to the drain of M-5 as shown in FIG. 1.

If a designer so desires, the transistor M-4 of FIG. 1 could be removed without altering the operation of the circuit. The transistor M-7 of FIG. 1 is included in the circuit shown in FIG. 1 to assure that the circuit becomes functional when it is intially powered up. The transistor M-7 should be constructed with a high resistance by making its gate length large. Gate length is used herein to mean the average distance under the insulated gate between the source and the drain of the transistor. The transistor M-7 is used because, without it, it is possible that the circuit will remain off upon powering up. By including the transistor M-7, it is assured that transistors M-2 and M-5 of FIG. 1 will be turned on, which will then cause transistors M-1 and M-3 to become functional.

Figure 2:
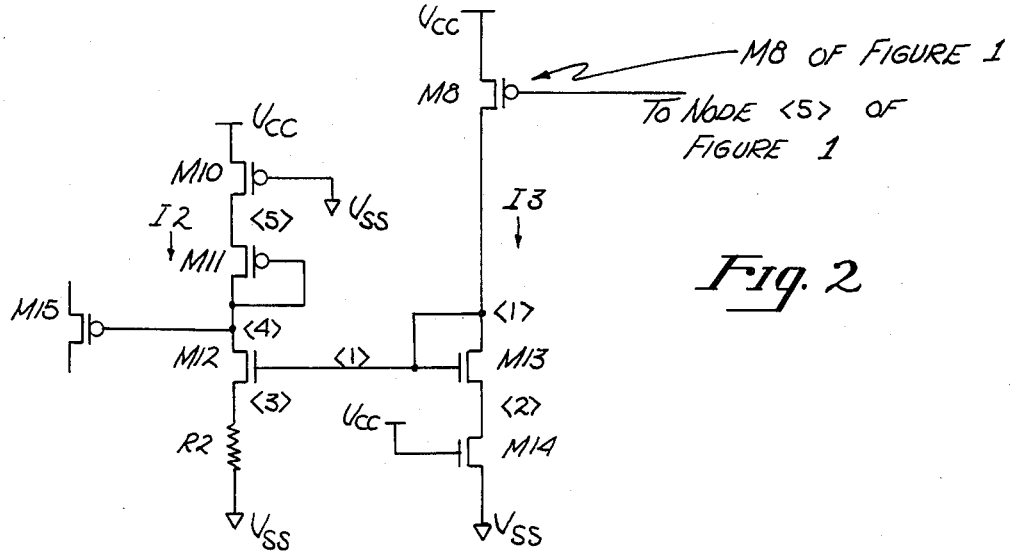
FIG. 2 shows an embodiment of a voltage generator circuit which controls the gate bias voltage.

A reference voltage developed by node 5 of FIG. 1 produces a constant current through the transistor M-8 of FIG. 1. it is that constant current through transistor M-8 of FIG. 1 which is used in the circuit shown in FIG. 2, which circuit is the voltage generator circuit that controls the gate bias voltage which compensates for variations in transconductance due to variations in temperature and manufacturing tolerances. Resistance R-1 of FIG. 1 is used so that a stable resistance, over variations in temperature, is developed to assure that the current through M-8 will be substantially stable over variations of temperature and differences in transistors (e.g. channel length) due to manufacturing tolerances.

FIG. 2 shows an embodiment of the voltage generator circuit that modulates the gate bias voltage to compensate for variations in temperature and/or manufacturing tolerances. This voltage generator generates a voltage at node 4 of FIG. 2 that is varied to compensate for variations in temperature and manufacturing tolerances. That voltage at node 4 of FIG. 2 is applied to the gate of an MOS transistor, shown as M15 of FIG. 2, which transistor is usually incorporated into the circuit, the behavior of which circuit the designer wishes to modify so that it is more stable over variations in, for example, temperature. The end result is that the MOS transistor (M15 of FIG. 2) coupled, through its gate, to node 4 will actually reverse, in the typical use of the invention, the natural response due to variations in temperature of the circuit desired to be controlled ("target circuit"). Thus, for example, when transconductance would, without the invention, be reduced because temperature has increased from T1, to T2, the circuit of the invention will actually increase the transconductance of M15 so much that the conductance through the subject circuit is at least maintained at the level when the temperature was at $T_1$ and will often increase the conductance beyond that level.

Referring to FIG. 2, the MOS transistor M14 (of FIG. 2) is biased to operate in its linear region of operation. As the temperature decreases, the transconductance of an MOS device, such as M14 of FIG. 2, increases with electron mobility, as defined by the formula $u_{eff}=u_o[(273+X^\circ\ C.)/300^\circ\ K]^{-1.5}$, where $u_o$ is the mobility measured at 27 degrees Centigrade and X is the operating temperature of the circuit. Generally, when the transconductance increases, the current through the source and drain ("IDS") of an MOS device increases. When an MOS device operates in its linear region of operation, the current through the source and drain of the device is given by $I_{DS}=u_{eff}(W/L)C_{ox}(VGS-Vth-VDS/2)V_{DS}$. Thus it can be seen that as the temperature decreases, the effective resistance of the MOS transistor M14 of FIG. 2 decreases. Since M-8 from FIG. 1, which is also shown in FIG. 2, provides a constant current source, the voltage at node 2 of FIG. 2 drops with decreasing temperature; the voltage at node 2 drops to the value of the voltage across the source and drain of M14 that sustains the current flow I3 through M14. The voltage on node 1 maintains the value of the voltage across the source and drain of M13 (of FIG. 2) that sustains the current 13 through M13. The voltage at node 3 of FIG. 2 is made nearly equal to the voltage at node 2 since node 1 is the gate of M12 and M13, and M12 and M13 are sized to have equal current densities (e.g. substantailly same physical parameters). The current I-2 of FIG. 2 is fixed by the voltage on node 3 from the size of the resistor R2, such that I-2 is equal to V(3) divided by R2. Fixing I-2 determines the voltage drops across M10 and M11 of FIG. 2. It can be seen that the voltage at node 4, FIG. 2, is given by the expression $V(4)=V_{supply}-V_{DS}(M10)-V_{DS}(M11)$. Since the voltage at node 3 of FIG. 2 is made nearly equal to the voltage at node 2 of FIG. 2, and since the voltage at node 3 is equal to (I2)(R2), it can be seen that I-2 will decrease when temperature decreases. That is, voltage variation at node 2 of FIG. 2 will cause proportional current variation through R2. When the temperature decreases, I-2 will decrease; when the temperature increases, I-2 wil increase. It can be seen that when I-2 decreases, the voltage on the gate of M15 of FIG. 2 increases (that is, the gate to source voltage decreases). Similarly, when I-2 increases, then the gate to source voltage on M15 increases (that is, the voltage at node 4 decreases). Thus, the circuit of FIG. 2, in conjunction with the circuit of FIG. 1, causes a variation on the gate bias voltage of M15 of FIG. 2 to compensate for changes in temperature and to compensate for differences in the parameters of the transistors due to manufacturing tolerances.

The transistor M11 of FIG. 2 is usually made large (e.g., the gate length is made large) and its function is to offset the voltage at node 4 of FIG. 2 from the voltage at node 5 of FIG. 2 by a p-channel transistor threshold voltage. The drain to source voltage drop across the transistor M10 will then set the gate drive (VGS-Vth)

of the transistor M15 of FIG. 2, which transistor affects the circuit whose behavior is being modified in order to compensate for variations in temperature. Transistor M10 of FIG. 2 works in concert with transistor M14 of FIG. 2 because, as temperature decreases, the transconductance of M10 increases, causing the drop across M10 to be less, which in turn decreases the gate drive on transistor M15 of FIG. 2. The transistor M-8 of FIG. 2, which is also the same transistor M-8 of FIG. 1, should be maintained in saturation to properly act as current source for the circuit of FIG. 2.

Figure 3:
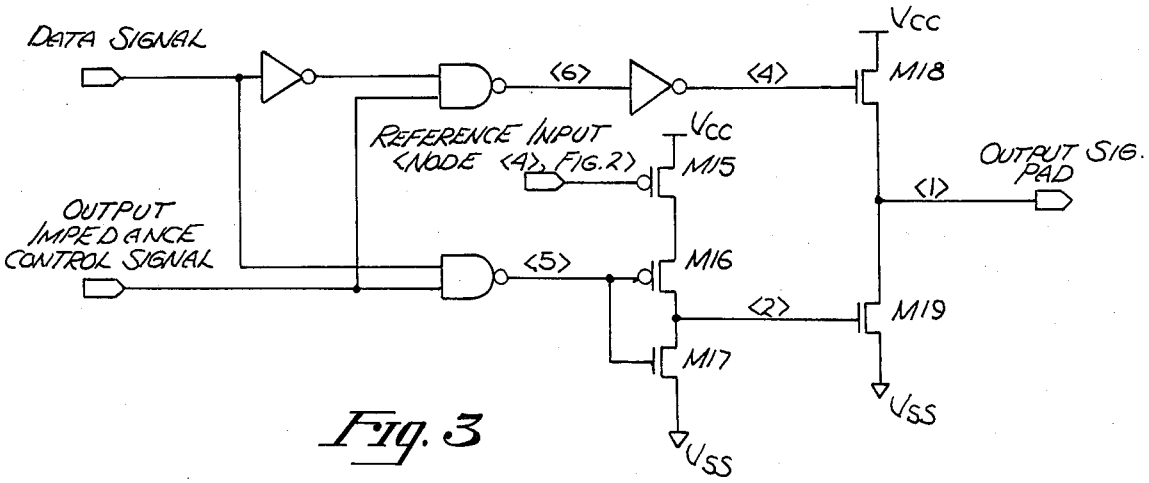
FIG. 3 shows the use of the invention in an output buffer.

There are several applications of the invention in a design of digital integrated circuits. One application is the inclusion of the invention in the stage that drives an output pulldown transistor in an output buffer. In the design of digital integrated circuits, there is particular concern with the di/dt (i.e. the change in current with respect to time) in an output transistor. This di/dt, in conjunction with parasitic inductance, causes unwanted voltage fluctuations in the power supply feeds, which can cause the integrated circuit to malfunction. Variations in temperature and manufacturing processing cause this switching di/dt in the output transistors to vary greatly. By applying the invention to modulate the rise time of the gate drive voltage of the output transistor and, in particular, the ouput pulldown transistor of an output buffer, the di/dt variation with manufacturing and temperature variations is reduced, which reduces the worst case power supply fluctuations that the integrated circuit experiences. FIG. 3 shows such a use of the invention. FIG. 3 shows that by combining the circuits of FIG. 2 and FIG. 1 (the bridging transistor M-8, which is found in both FIG. 1 and FIG. 2 is not normally duplicated), one may modulate through transistors M16 and M17 of FIG. 3 the gate bias voltage of the output pulldown transistor M19 of FIG. 3. Node 4 from FIG. 2 is coupled to the P-MOS transistor M15 shown in FIG. 3, the drain of which is coupled to the source of transistor M16 of FIG. 3. The voltage at node 2 is taken from the output of the inverter circuit formed by M16 and M17 of FIG. 3, and the voltage at node 2 will drive the output pulldown transistor which pulls the output down to ground at the appropriate times, such as, for example, when the output should be "0" in the case of a positive logic.

The transistor M15 of FIG. 3 limits the amount of current suppled to M16 (of FIG. 3) so tha the rising voltage transistion on node 2 can be manipulated by the invention. When the data signal switches from the one state, "high", to the zero state, "low", the voltage on node 4 (FIG. 3) will fall and the voltage on node 2 will rise, turning off M18 and turning on M19. Turning on M19 causes node 1 to be pulled down. The rise time of node 2 affects the rate of current change, di/dt, trhough M19. The circuit shown in FIG. 3 works because the transistor M15, driven by the invention, of FIG. 3, when the circuit is "cold" (i.e. under conditions that increase transconductance), limits the amount of current which is supplied to the transistor M16, which in turn restricts the gate bias voltage on transistor M19 of FIG. 3. That is, under conditions that increase the transconductance of M19, the invention decreases the gate drive to M15 and, consequently, the current available to change node 2 to a "high" state is decreased. This, in turn, slows the response time of transistor M19 so that it does not switch too fast when the circuit is cold. Of course, switching too fast causes di/dt to be very large and thereby causes voltage fluctuations across parasitic inductors. Thus, it can be seen that the invention will improve the characteristics of an output buffer. It is noted that when the circuit is hot, M15 conducts more (since the transconductance is reduced with higher temperature, gate drive is modulated to permit more current to flow through M15), thus increasing the speed with which the gate bias voltage increases on the transistor M19, FIG. 3, which permits faster response time by transistor M19 of FIG. 3.

Another application of the instant invention is the use of the invention in timing circuits, such as in clocked MOS circuits. For example, the invention may be used to modulate the resistance in an RC circuit which is used to control timing parameters in a circuit. Typically, timing parameters are specified at one value over the entire temperature operating range of an IC. Timing parameters tend to fall into one of three major categories: propagation delay, set-up time and hold time. Set-up and hold times are parameters that specify the relation of a data input signal to a gating or clock input signal. Therefore, a race condition between the two signals will occur inside the part. The set-up and hold times specify the leading and trailing edge of valid data with respect to the gating signal, respectively, and therefore create a window in time when the data signal must be valid. Many times the racing signals must be adjusted so that a given offset time is maintained. Since decreasing temperature will cause the chains of gate delays to compact in time, it is sometimes necessary to add delays in one path to the other to maintain the specified timing parameters. Using the invention to create a circuit stage that slows down as the remaining stages speed up will stabilize the overall speed of the chain, which in turn will allow the circuit to operate within a smaller window of hold time and set-up time than otherwise possible. Such a use of the invention is shown in FIG. 4.

Figure 4:
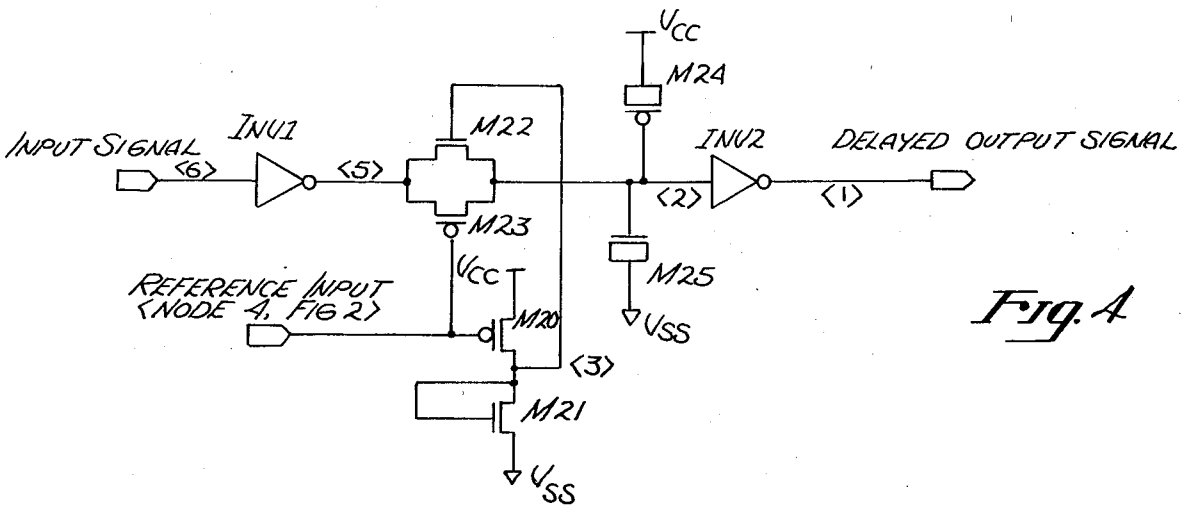
FIG. 4 shows the use of the invention to control the resistance in an RC circuit.

FIG. 4 is a circuit that reverses the usual speed changes which occur with temperature and component variations, given the input from the reference circuit of FIG. 2. Node 4 from the reference circuit of FIG. 2 is applied to the gates of the transistors M23 and M20 of FIG. 4. The MOS transistors M22 and M23 of FIG. 4 replace a resistor in a typical RC delay configuration. The transistor M23 of FIG. 4 is the same transistor M15 shown in FIG. 2. The gate voltage on transistor M20 of FIG. 4 sets the current through transistor M21 of FIG. 4, and the voltage on node 3 is maintained at the value of the voltage across the gate and source of transistor M21 of FIG. 4 that supports the current through transistor M21 of Figure 4. The voltage on the gate of M21 is mirrored to the gate of M22 of FIG. 4 so that the current-carrying capability of M22 is the same as M20 and therefore M23 of FIG. 4. The equal current-carrying capability of M21 and M22 guarantees equal rise and fall times of node 2 when node 5 switches. The references circuit alters the gate voltage of transistor M23 of FIG. 4 directly and transistor M22 of FIG. 4 indirectly so that more current is available to charge the capacitors (M24 and M25) and the inverter gates connected to node 2 when the temperature is hot and the conventional stages are slowing down. Alternatively, less current is available to charge the capacitors when the temperature is cold. This compensation offsets the natural response of MOS circuits. The increased current in the hot case allows node 2 to switch faster, which compensates for other logic circuits slowing down, thereby stabilizing the propagation delay of the circuit over temperature. The reference circuit also compensates between different parts with different physical parameters so that the speed of the circuit can be stabilized from part to part. The size of transitors M22 and M23 of FIG. 4 can be adjusted so that the circuit can compensate for one, two or more stages of logic.

Figure 5:
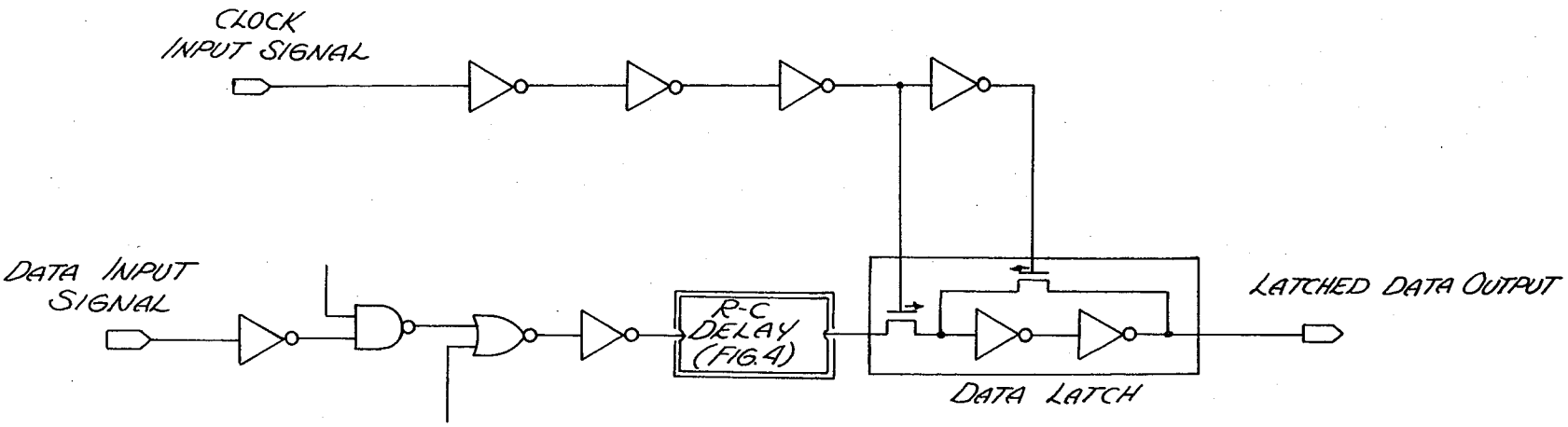
FIG. 5 shows the use of the invention to control the resistance in an RC delay which RC delay is incorporated into a clocked MOS circuit.

FIG. 5 demonstrates a circuit that uses the circuit of FIGS. 1, 2 and 4 to compensate one stage of logic. The internal race condition between the clock input and the data input will have a stabilized offset, since there are three gate delays in the clock path and three uncompensated gate delays in the data path up the latch where the gating action occurs. The offset delay is often preferred over exactly equal delay for many applications. If the data is held for a positive period of time before the clock pulse, the RC delay shown in FIG. 5 is unnecessary. While the invention has been described by reference to a particular embodiment, various modifications of that embodiment, as well as other embodiments, can be utilized by persons skilled in the art upon reference to this description and that the scope of the invention is defined by the following claims.

We claim:

1. In an MOS circuit, a reference circuit for compensating for the natural response of said MOS circuit to changes in temperature, said reference circuit comprising:

(a) a voltage reference circuit that generates a stable current over variations of temperature said voltage reference circuit comprising, (i) a first MOS transistor having a source and a drain and being biased so that its change in threshold voltage due to temperature variations is compensated by its change in transconductance due to temperature variations to thereby tend to maintain the current through said source and said drain of said first MOS transistor at a substantially constant value;

(ii) a current mirror circuit having a first current path and a second current path, said first MOS transistor being coupled to said first current path of said current mirror circuit to modulate the current in said second current path of said current mirror said source and said drain of said first MOS transistor being part of said first current path;

(iii) a first resistor being coupled to said second current path of said current mirror circuit, the voltage across said first resistor being substantially stable over variations of temperature;

(iv) a second MOS transistor having a source and a drain and having a gate coupled to said second current path of said current mirror circuit to receive a voltage that is modulated such that the current through said source and said drain of said second MOS transistor is substantially stable over variations of temperature;

(b) a voltage generator circuit being coupled to the gate of a third MOS transistor and having means for modulating the gate bias voltage of said third MOS transistor such that the gate bias voltage of said third MOS transistor is varied to compensate for variations in temperature, said voltage generator circuit being coupled to one of the source and drain of said second MOS transistor to receive the current through said source and said drain of said second MOS transistor said voltage generator circuit having a third current path and a fourth current path, the source and the drain of said second MOS transistor being part of said third current path and said gate of said third MOS transistor being coupled to said fourth current path to apply said gate bias voltage to said gate of said third MOS transistor;

whereby, under conditions where the transconductance of an MOS transistor decreases, the voltage applied to the gate of said third MOS transistor changes to compensate for variations in transconductance due to variations in temperature.

2. In an MOS circuit, a reference circuit for compensating for the natural response of said MOS circuit to changes in temperature, said reference circuit comprising:

(a) a voltage reference circuit that generates a stable current over variations of temperature comprising, (i) a first MOS transistor having a source and a drain, said first MOS transistor being biased so that its change in threshold voltage due to variations in temperature is copensated by its change in transconductance due to variations in temperature to thereby tend to maintain the current through said source and said drain of said first MOS transistor at a substantially constant value;

(ii) a second MOS transistor having a source and a drain and a gate, one of the source and drain of said first MOS transistor being coupled to one of the source and drain of said second MOS transistor to form a first current path, said source and said drain of said first MOS transistor and said source and said drain of said second MOS transistor forming a part of said first current path, the drain of said second MOS transistor being coupled to the gate of said second MOS transistor, the gate of said second MOS being coupled to a gate of a third MOS transistor and the physical parameters of said second and third MOS transistors being substantially similar so that the current through said second MOS transistor is substantially equal to the current through said third MOS transistor, said third MOS transistor having a source and a drain, said source and said drain of said third MOS transistor forming part of a second current path, said current through said third MOS transistor being substantially stable over variations of temperature;

(iii) a first resistor coupled to one of the source and drain of said third MOS transistor and being part of said second current path, the voltage across said first resistor being stable over variations of temperature;

(iv) a fourth MOS transistor having a source and a drain and a gate, the gate of said fourth MOS transistor being coupled to one of the source and drain of said third MOS transistor so that the gate of said fourth MOS transistor is at the voltage across said first resistor and said third MOS transistor so that the current through said fourth MOS transistor is substantially stable over variations of temperature said source and said drain of said fourth MOS transistor being part of a third current path;

(b) a voltage generator circuit coupled to a fifth MOS transistor having a gate, said voltage generator circuit being coupled to said gate of said fifth MOS transistor and modulating the voltage on the gate of said fifth MOS transistor such that the gate to source bias of said fifth MOS transistor is varied to compensate for variations in temperature, said voltage generator circuit comprising;

(i) a sixth MOS transistor being biased to operate linearly and having a source and a drain, and a seventh MOS transistor having a source and a drain and a gate, one of the source and drain of said sixth MOS transistor being coupled to one of the source and drain of said seventh MOS transistor and the other of the source and drain of said seventh MOS transistor being coupled to one of the source and drain of said fourth MOS transistor to receive the current through said fourth MOS transistor such that the current through said sixth MOS transistor is substantially stable over variations of temperature and the voltage across the source and drain of said sixth MOS transistor varies according to the resistance across the source and drain of sixth MOS transistor, the drain of said seventh MOS transistor being coupled to the gate of said seventh MOS transistor said sources and said drains of said fourth, sixth and seventh MOS transistors being part of said third current path;

(ii) and eighth MOS transistor having a gate, a source and a drain, the gate of said eighth MOS transistor being coupled to the gate of said seventh MOS transistor and the physical parameters of said seventh and eighth MOS transistors being substantially similar, said source and said drain of said eighth MOS transistor being part of a fourth current path;

(iii) a second resistor coupled to one of the source and drain of said eighth MOS transistor and being part of said fourth current path, changes in the voltage across the source and drain of the sixth MOS transistor being reflected in proportional changes in current through the source and drain of said eighth MOS transistor and second resistor, the gate of said fifth MOS transistor being coupled to one of the source and drain of said eighth MOS transistor such that the voltage across said second resistor and the source and drain of said eighth MOS transistor is applied to the gate of said fifth MOS transistor, the voltage applied to the gate of said fifth MOS transistor being varied to compensate for variations in temperature such that under conditions where the transconductance of an MOS transistor decreases, the voltage applied to the gate of said fifth MOS transistor changes to increase the transconductance of said fifth MOS transistor, thereby compensating for variations in transconductance due to variations in temperature and channel length.

3. In an MOS circuit, a reference circuit for compensating for the natural response of said MOS circuit to changes in temperature, said reference circuit comprising:

(a) a voltage reference circuit that generates a stable current over variations of temperature comprising, (i) a current mirror circuit having a first current path and a second current path, said first current path including a first MOS transistor and a second MOS transistor, said first MOS transistor being coupled to said second MOS transistor to form part of said first current path, said second current path including a third MOS transistor and a fourth MOS transistor, said third MOS transistor being coupled to said fourth MOS transistor to form part of said second current path so that the current through said third MOS transistor is substantially equal to the current through said fourth MOS transistor, each of said first, second, third and fourth MOS transistors having a gate, the gates of said first and third MOS transistor being coupled and the gates of said second and fourth MOS transistor being coupled, said first and third MOS transistors having substantially similar physical parameters and said second and fourth MOS transistors having substantially similar physical parameters so that the current through said first current path is substanitally equal to the current through said second current path;

(ii) a fifth MOS transistor coupled to said first current path of said current mirror so that the current through said second MOS transistor is equal to the current through said fifth MOS transistor, said fifth MOS transistor being biased so that its change in threshold voltage due to temperature variations is compensated by its change in transconductance due to variations in temperature so that the current through said first current path of said current mirror is substantially stable over variations of temperature and the current through said second current path of said current mirror is substantially stable over variations of temperature;

(iii) a first resistor coupled to said second current path of said current mirror so that the current through said third MOS transistor is equal to the current through said first resistor, the voltage across said first resistor and said fourth MOS transistor being a function of the current through said resistor, (iv) a sixth MOS transistor having a source and a drain and a gate, said gate of said sixth MOS transistor being coupled to one of the source and drain of said fourth MOS transistor such that said gate of said sixth MOS transistor is at the voltage across said first resistor and said fourth MOS transistor so that the current through said sixth MOS transistor is substantially stable over variations of temperature said source and drain of said sixth MOS transistor being part of a third current path;

(b) a voltage generator circuit coupled to a seventh MOS transistor having a gate, said voltage generator circuit modulating the gate bias voltage of said seventh MOS transistor such that the gate to source bias of said seventh MOS transistor is varied to compensate for variations in temperature, said voltage generator circuit comprising;

(i) an eighth MOS transistor being biased to operated linearly and having a source and a drain, and a ninth MOS transistor having a source and a drain, one of the source and drain of said eighth MOS transistor being coupled to one of the source and drain of said ninth MOS transistor and the other of the source and drain of said ninth MOS transistor being coupled to one of the source and drain of said sixth MOS transistor to receive the current through said sixth MOS transistor such that the current through said eighth MOS transistor is subtantially stable over variations of temperature and the voltage across the source and drain of said eighth MOS transistor varies according to the resistance across the source and drain of said eighth MOS transistor said sources and said drains of said eighth and said ninth MOS transistors being part of said third current path;

(ii) a tenth MOS transistor having a gate, a source and a drain, the gate of said tenth MOS transistor being coupled to the gate of said ninth MOS transistor and the physical parameters of said ninth and tenth MOS transistors being substantially similar said source and said drain of said tenth MOS transistor being part of a fourth current path;

(iii) a second resistor coupled to one of the source and drain of said tenth MOS transistor to form part of said fourth current path, changes in the voltage across the source and drain of said eighth MOS transistor being refelected in proportional changes in the current through the source and drain of said tenth MOS transistor and the second resistor, the gate of said seventh MOS transistor being coupled to one of the source and drain of said tenth MOS transistor such that the voltage across said second resistor and the source and drain of said tenth MOS transistor is applied to the gate of said seventh MOS transistor, the voltage applied to the gate of said seventh MOS transistor being varied to compensate for variations in temperature such that under conditions where the transconductance of an MOS transistor decreases because of an increase in temperature, the voltage applied to the gate of said seventh MOS transistor changes to increase the transconductance of said seventh MOS transistor in such a manner to reverse the natural variation in transconductance due to temperature to thereby modify the behavior of said MOS circuit.

4. The circuit of claim 3 further comprising: means for controlling the gate voltage bias of a pull down MOS transistor in an output buffer, said pull down MOS transistor, when activated, being used to pull the output to a certain predefined value, said means for controlling being coupled to said seventh MOS transistor so that the effect of temperature variation on said pull down transistor is compensated for by said seventh MOS transistor, whereby the natural response of said output buffer to variations in temperature is compensated for by said reference circuit.

5. The circuit of claim 3 wherein said seventh MOS transistor is a p-channel MOS insulated gate field effect transistor and said sixth MOS transistor is a p-channel MOS insulated gate field effect transistor.

6. A reference circuit for modulating a resistor means, said resistor means being modulated to compensate for the natural response of MOS circuits to variations of temperature, said reference circuit comprising:

a first MOS transistor biased so that its change in threshold voltage due to temperature variations is compensated by its change in transconductance due to temperature variations;

a current mirror circuit having a first current path and a second current path, said first MOS transistor being coupled to said first current path of said current mirror circuit to modulate the current in said second current path of said current mirror;

a second MOS transistor having its gate coupled to said second current path of said current mirror to receive a voltage that is modulated such that the current through said second MOS transistor is substantially stable over variations of temperature;

a voltage generator circuit having means for modulating said resistor means, said voltage generator circuit being coupled to said second MOS transistor to receive the current through said second MOS transistor, said resistor means being responsive to said voltage generator circuit such that under conditions of temperature where transconductance of an MOS device decreases, the resistance of said resistor means decreases to compensate for the natural response of MOS circuits to variations of temperature.

7. The reference circuit as in claim 6, wherein said resistor means is coupled to a capacitor to form an R-C circuit whereby said capacitor may be charged to a predefined voltage such that said capacitor charges faster under conditions of temperature where transconductance of an MOS device decreases thereby compensating for the natural response of MOS circuits to variations in temperature.

8. The reference circuit as in claim 7, wherein said R-C circuit is coupled to an MOS circuit so that said R-C circuit delays signals through said MOS circuit under conditions of temperature where transconductance of an MOS device increases.

* * * * *